United States Patent [19]

Dick et al.

[11] 4,297,752

[45] Nov. 3, 1981

[54] CONVERTIBLE FURNITURE

[75] Inventors: Calvin Dick, 2725 Cooper Ct., Apt. 1, Napa, Calif. 94558; Patrick C. Malone, Richardson, Tex.

[73] Assignee: Calvin Dick, Napa, Calif.

[21] Appl. No.: 58,070

[22] Filed: Jul. 16, 1979

[51] Int. Cl.[3] ..... A47C 17/12; A47C 17/16; A47C 17/04

[52] U.S. Cl. ..... 5/52; 5/59 R; 297/115

[58] Field of Search ..... 5/58, 52, 53 R, 53 B, 5/53 C, 43, 47, 45, 46; 297/115 R, 94; 5/59 R, 59 B, 59 C

[56] References Cited

U.S. PATENT DOCUMENTS

| | | | |
|---|---|---|---|
| 187,932 | 2/1977 | Sullivan | 297/94 |
| 1,435,960 | 11/1922 | Glocker | 5/43 |
| 2,844,828 | 7/1958 | Stark | 5/45 |
| 2,931,052 | 4/1960 | Todorovic | 5/52 |

*Primary Examiner*—Roy D. Frazier
*Assistant Examiner*—Alexander Grosz
*Attorney, Agent, or Firm*—Mark C. Jacobs

[57] ABSTRACT

A convertible article of furniture presenting a loveseat or couch in one arrangement and a day bed in the other. As a loveseat or couch, the article of furniture has a back rest and arm rests which are moveable out of the way to convert the loveseat or couch to a day bed. Optionally, an enclosed storage area is provided and the article is both portable and usable as a loveseat or couch from either side.

8 Claims, 8 Drawing Figures

CONVERTIBLE FURNITURE

BACKGROUND OF THE INVENTION

1. FIELD OF THE INVENTION

The invention relates to convertible furniture; and, more particularly, to an article of furniture which is quickly and easily convertible between a loveseat or couch to a daybed.

2. DESCRIPTION OF THE PRIOR ART

Various types of convertible furniture have been known in the past. Generally, such furniture has not been received with great enthusiasm since it is difficult to provide an article of furniture having features peculiar to that article, then remove or change their position to present a different article of furniture having features peculiar to that article. Further, such prior convertible furniture has been relatively expensive and complex. No furniture of this type is known which converts between a loveseat or couch and a daybed.

SUMMARY OF THE INVENTION

It is an object of this invention to present an article of furniture which is quickly and easily convertible between a loveseat or couch and a daybed.

It is still further an object of this invention to carry out the foregoing object in an inexpensive manner.

It is another object of this invention to provide such article of furniture which is portable and has an enclosed storage area.

These and other objects are preferably accomplished by providing a loveseat or couch having a back rest and arm rests which are foldable out of the way to convert the article to a daybed. The back rest is moveable so the couch or loveseat can be used from either side and the article is portable and optionally may include a built-in enclosed storage area.

DESCRIPTION OF THE PREFERRED EMBODIMENT

Figure 1:
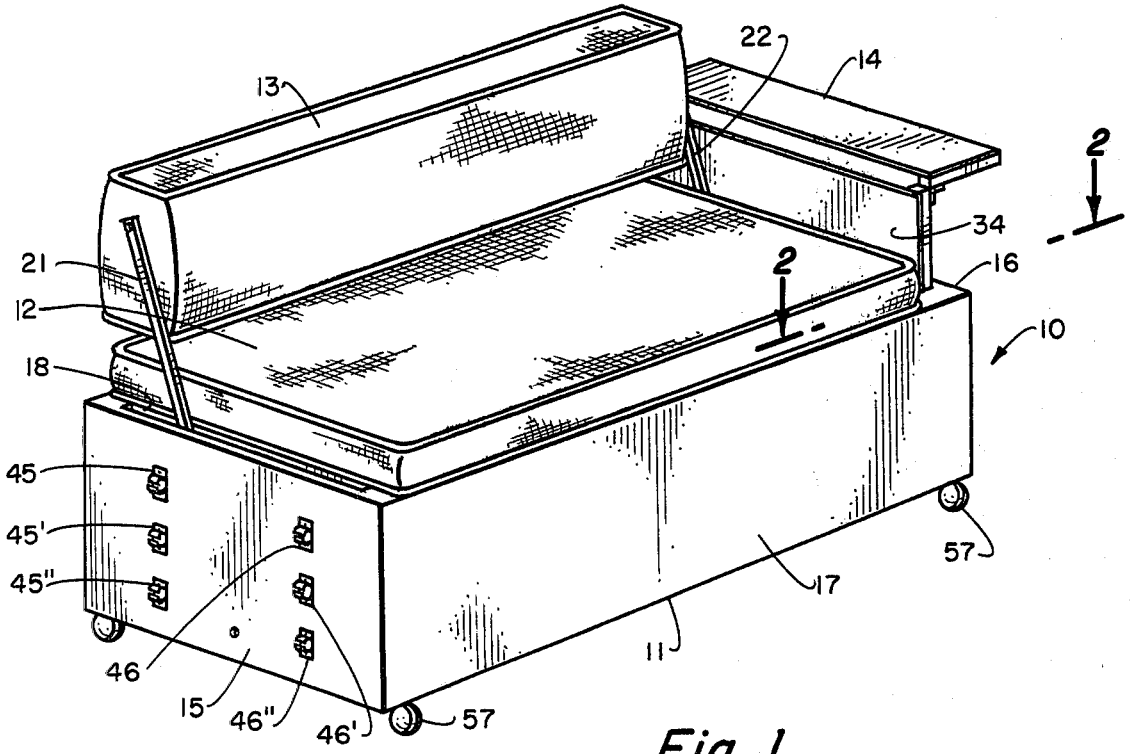
FIG. 1 is a perspective view of an article of furniture in accordance with the teachings of our invention.

Referring now to FIG. 1 of the drawing, a convertible article of furniture 10 is shown comprising a bottom section 11, a seat cushion 12 supported on the bottom section 11, a back rest 13 and a tray or arm rest 14. Bottom section 11 is a generally rectangular section which may be a completely enclosed box-like structure formed of suitable panels of a suitable material, such as plastic, sheet metal, wood, etc. Thus, in FIG. 1, storage area or bottom section 11 may be comprised of side panels 15,16 interconnected with front and rear panels

17,18. If desired, a bottom panel (not visible) may close off the open bottom.

Figure 2:
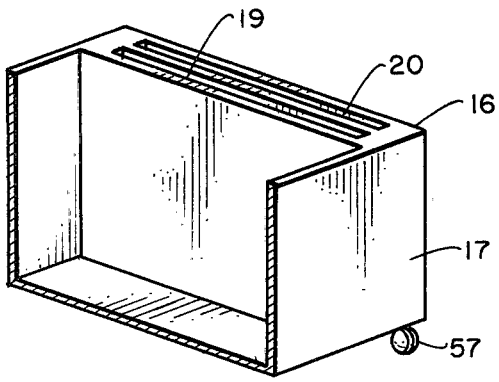
FIG. 2 is a view taken along lines II—II of FIG. 1.

As shown in FIG. 2, the side walls 15,16 may each include a support panel having a plurality of cut outs or slots, such as slots 19,20. Referring again to FIG. 1, seat cushion 12 rests on the top of side walls 15,16. Seat cushion 12 may be of a foam material covered with fabric having a rigid supporting base to provide support and rigidity. Cushion 12 may be removably mounted on top of side walls 15,16 so that the hollow inner surface of bottom section 11 may be used for storage. Cushion 12 may be wide enough and long enough to accommodate a supine adult, e.g. 36"×72".

Figure 3:
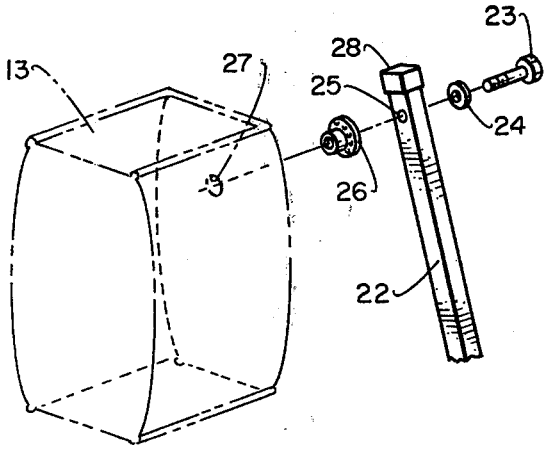
FIG. 3 is a detailed view of the connection of the back rest of FIG. 1 to a supporting bracket.

Back rest 13 may also be a foam fabric-covered material backed with a rigid support (or a wooden or metal frame, covered with a cushioning material) and is fixedly secured to a pair of supporting arms or brackets 21, 22. As shown in FIG. 3, bracket 22 is secured to back rest 13 by a screw 23 passing through a washer 24 into a suitable aperture 25 in bracket 22. A threaded press-in anchoring sleeve 26 is press-fit into a suitable aperture 27 in back rest 13 and screw 23 is then threaded therein. A plastic cap 28 may close off the top of bracket 22. Bracket 21 is assembled to the other side of backrest 13 in like manner.

Figure 4:
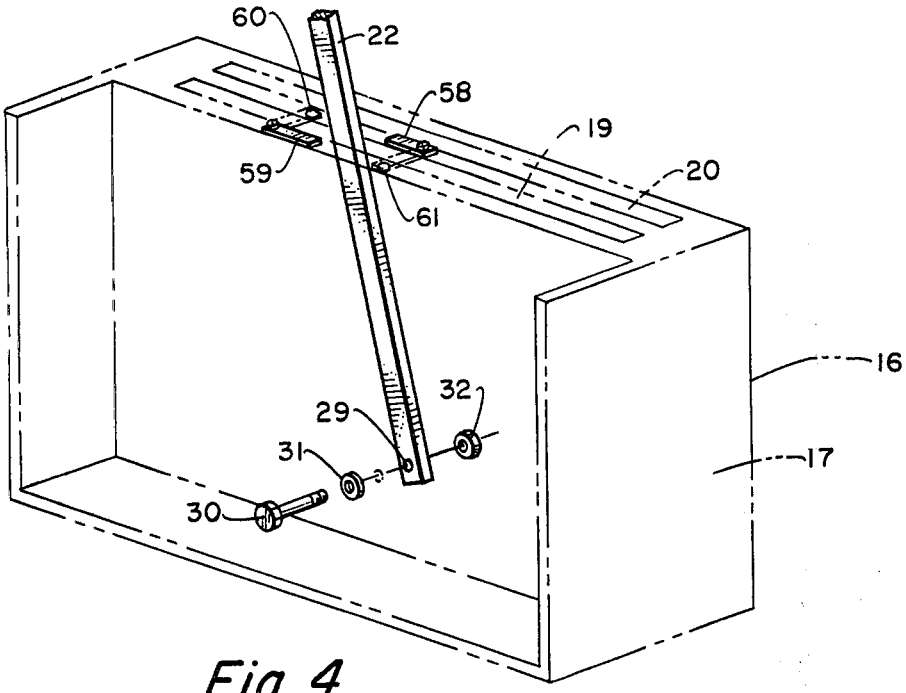
FIG. 4 is a detailed view of the connection of the bracket of FIG. 3 to the side wall of the article of FIG. 1.

As shown in FIG. 4, the other end of bracket 22 passes through slot 19 in side panel 16 and includes an aperture 29 at its lower end receiving therein the threaded end of a screw 30 passing through washer 31 into aperture 29 and threaded on nut 32.

Figure 5:
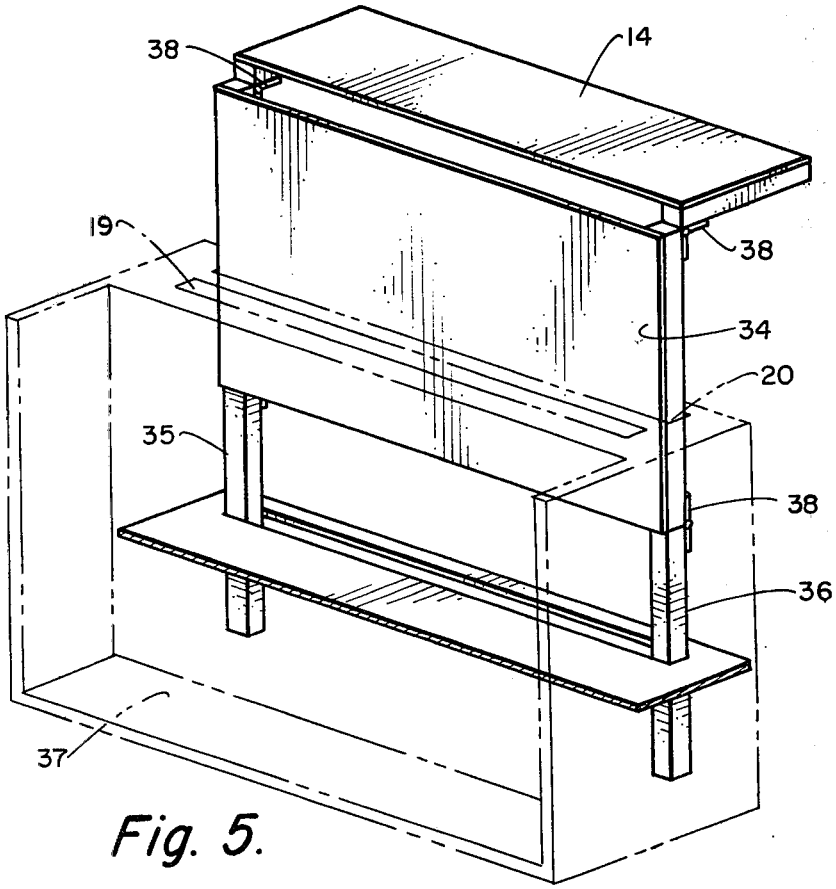
FIG. 5 is a detailed view of the arm rest of FIG. 1 and its association with the side wall thereof.

As shown in FIG. 1, a tray or arm rest 14 is hingedly secured to a side panel 34 which, as shown in FIG. 5, extends down into slot 20. As shown, side panel 34 may be particle board or the like secured to rods 35,36 which extend down into slot 20 and rest on the bottom or floor 37. It can be seen that, to convert the article of FIG. 1 to a daybed, rods 35,36 (and, of course, panel 34 and arm rest 14) may be easily and quickly lifted up from slot 20 as will be discussed. Also, as discussed, although only one arm rest 14 is shown in FIG. 1, a second may be provided associated with side panel 15. Panel 34 may be hinged via hinges 38 to legs or rods 35,36. Similar hinges 38 may be used to hingedly secure rest 14 to panel 34.

Figure 6:
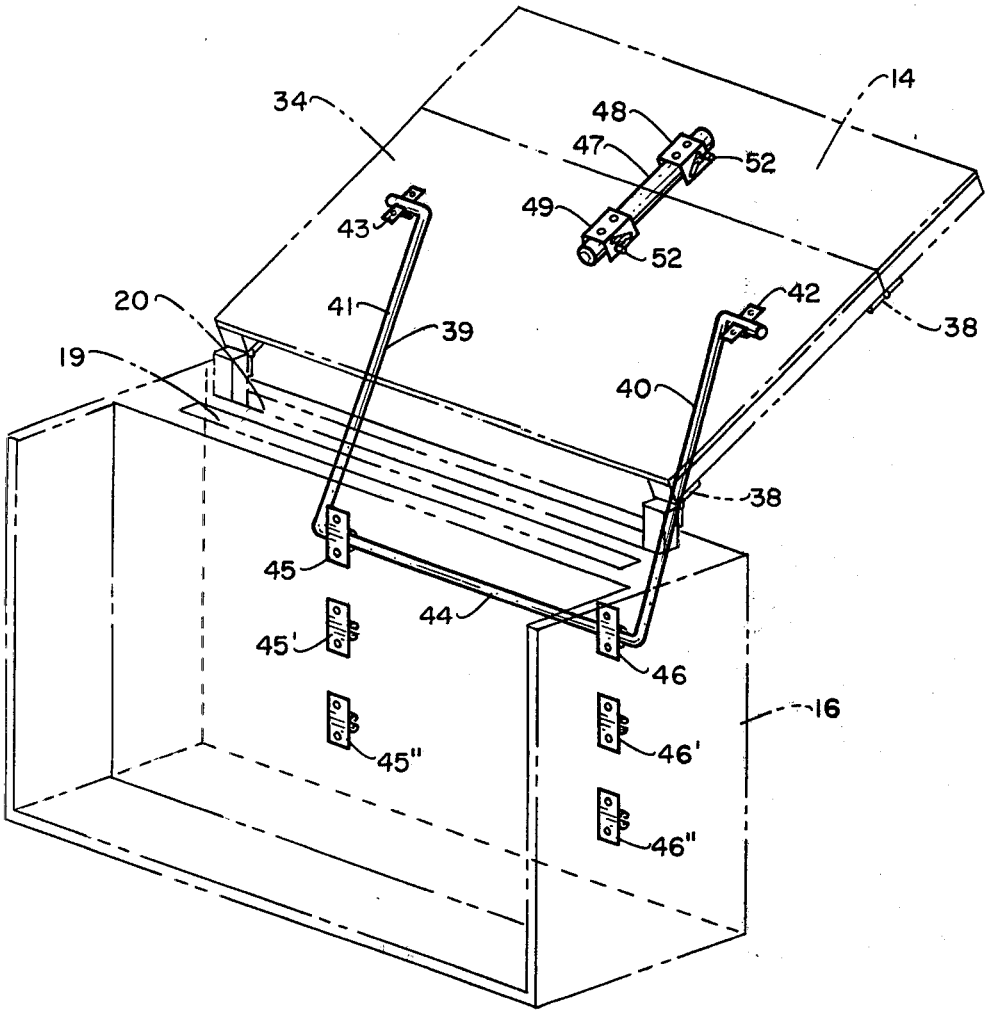
FIG. 6 is a detailed view of the mechanism of the arm rest of FIG. 1.
Figure 7:
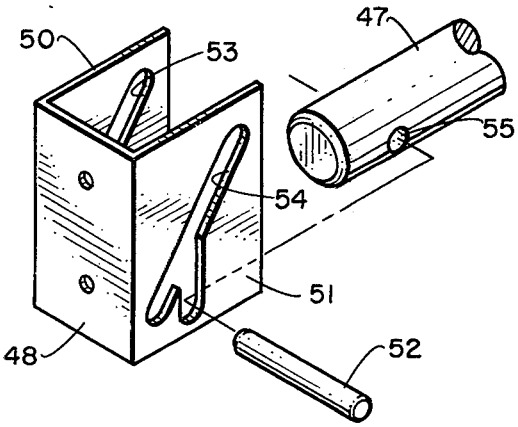
FIG. 7 is a detailed view of the connection of the arm rest to its side panel.
Figure 8:
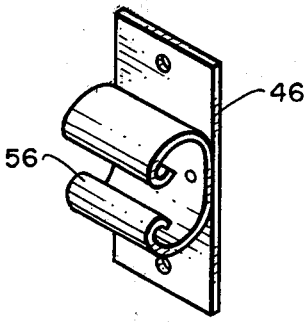
FIG. 8 is a perspective view of a locking clip in accordance with our invention.

As shown in FIG. 6, when converting the article of FIG. 1 to a daybed, rest 14 may be locked into a position parallel with panel 34 by means of a removable rod 47 mounted in brackets 48,49 (see FIG. 7) mounted on the underside of rest 14 and panel 34, respectively. As shown in FIG. 7, rod 47 enters the space between plates 50,51 of each bracket 48 or 49 with a removable pin 52 entering slots 53,54 in plates 50,51 respectively, and aligned apertures 55 in each end of rod 47. A U-shaped bracket 39 having legs 40,41 is secured at one end to clamps 42,43 respectively, on the underside of panel 34 with the bail 44 of bracket 39 rotatably and snap fittingly mounted in suitable spaced brackets 45,46 mounted to the outer surface of side panels 15, 16. Vertically spaced from brackets 45,46 are brackets 45', 46' and 45", 46" to provide a plurality of settings for bracket 39. Thus, the angularity of panels 14, 34 may be adjusted to provide a head rest of differing angles as will be discussed. The legs 40,41 of bracket 39 may be resilient so that they can be bent inwardly to quickly and easily remove legs 40,41 from engagement in clamps 42,43. The brackets or locking clips 45, 46 (and of course, clips 45',46' and 45",46") may be split or open at opening 56 (see FIG. 8) to remove the bracket 39 therefrom. In this manner the entire bracket 39 and rod 47 may be quickly and easily moved to a position orienting tray or rest 14 with respect to panel 34 as shown in FIG. 6 to provide a head rest or oriented as in FIG. 1 to provide arm rest 14. Finally, conventional spring-loaded casters 57 (FIG. 1) may be provided on the underside of bottom section 11 to make article 10 easily portable as is well known in the art.

Although the article of FIG. 1 has been described with seat cushion 12 as removable to provide access to the interior of bottom section 11 for storage or the like, front panel 17 may be hingedly secured to article 10 to open outwardly to provide access to the interior thereof.

As discussed, back rest 13 may be moved all the way to either the front or rear of FIG. 1 making the daybed or couch accessible from either side without the necessity of physically moving the article. Thus, brackets 21,22 abut against the terminal ends of slots 19 as seen in FIG. 4. If desired, however, as shown in FIG. 4, rotatable locking flanges 58,59 may be provided on panel 16 adjacent slot 19 which can be rotated to the dotted line position and screwed down with locking screws (not shown) which would enter apertures 60,61 thereby permitting brackets 21,22 to be supported in an intermediate position (and thus back rest 13). This would permit children, for example, to use the article as a couch from either side. When used in the FIG. 1 position (or entirely forwardly as discussed) the article 10 can be used as a room divider with the party desiring to recline being able to obtain access from either room. Suitable stopping means, such as locking flanges 58,59 and apertures 60,61, may be used to allow back rest 13 to stop at some desired intermediate point so a child or the like could be seated comfortably.

By making bracket 39 adjustable, a plurality of different angled head rests may be provided. Snap-on cushions or slide on cushions (not shown) may be provided to snap or slide on to arm rest 14 and panel 34 to provide cushioning means for the user's head. At the other side of article 10, like panels 34 and rests 14 are provided with similar adjustable angularity including provision to an almost flat or horizontal position to support the reclining party's feet. In this manner the head or legs of the user can be elevated to a variety of positions.

It can be seen that we have described an article of furniture that can be quickly and easily convertible between a loveseat or couch and a daybed.

We claim:

1. An article of furniture convertible between a couch or loveseat and a daybed or the like comprising:

a main housing comprising spaced front and rear walls interconnected by spaced side walls;

a horizontal seat closing off the upper surface of said main housing;

a back rest mounted on said main housing having a portion vertical with respect to said seat, and back rest connecting means coupling said vertical portion to said main housing for orienting said vertical portion from either a point adjacent the front of said main housing or the rear thereof;

an arm rest coupled to said main housing having a planar surface parallel to that of said seat in a first position;

arm rest connecting means connecting said arm rest to said main housing for alternately placing said arm rest in a first position wherein said planar surface thereof is spaced vertically upwardly from the planar surface of said seat to a second position wherein the planar surface of said arm rest is angularly disposed with respect to the planar surface of said seat, wherein said arm rest connecting means includes an elongated slot in at least one of said sidewalls, and an arm rest supporting means hingedly connected to said arm rest, extending down into said slot.

2. In the article of furniture of claim 1 wherein said back rest connecting means includes said side walls having elongated slots therein and brackets pivotally connected at one end to said vertical portion and having the other end extending down into said slots and pivotally connected to said respective side wall.

3. In the article of furniture of claim 1 wherein the area enclosed by said front, rear and side walls of said main housing is relatively hollow providing a storage area closed off at the top thereof by said seat.

4. In the article of furniture of claim 1 wherein said arm rest supporting means includes a pair of supporting legs extending down into said slot, a panel hingedly secured to said legs at one end extending partway down into said slot and hingedly secured to said arm rest at its other end.

5. In the article of furniture of claim 4 wherein said arm rest connecting means further includes a brace removably securable to both said arm rest and said panel for retaining said arm rest in a position coplanar with said panel.

6. In the article of furniture of claim 5 wherein said arm rest connecting means further includes means for maintaining both said arm rest and said panel, when said arm rest is coplanar with said panel, in a position wherein both said arm rest and said panel lie in a plane generally normal to that of said side wall.

7. In the article of furniture of claim 6 wherein said last-mentioned means includes a U-shaped bracket having a bail portion removably securable to bracket means on the outer surface of said side wall and spaced legs removably securable to spaced bracket means on the undersurface of said panel.

8. The article of claim 1 wherein the spaced front wall is hingedly secured to the balance of the main housing to provide access to the interiors of said main housing.

* * * * *